United States Patent [19]

Baer

[11] Patent Number: 4,743,047

[45] Date of Patent: May 10, 1988

[54] COMBINED BOOK AND MIRROR

[75] Inventor: Robert J. Baer, Honolulu, Hi.

[73] Assignee: RJB and C Company, Honolulu, Hi.

[21] Appl. No.: 942,301

[22] Filed: Dec. 16, 1986

Related U.S. Application Data

[63] Continuation-in-part of Ser. No. 664,021, Oct. 23, 1984, Pat. No. 4,637,631.

[51] Int. Cl.[4] ..... B42D 1/00; B42D 3/18; B42D 15/00; B08B 3/00

[52] U.S. Cl. ..... 281/15 R; 281/3 R; 281/22; 283/81; 132/83 R

[58] Field of Search ..... 281/3 R, 15 R, 22, 45; 283/81; 132/83 R; 401/126; D28/78; 350/600; 446/147; 362/253; 248/466

[56] References Cited

U.S. PATENT DOCUMENTS

| | | | |
|---|---|---|---|
| 470,861 | 3/1892 | Chichester | 281/3 R |
| 553,963 | 2/1896 | Palmer | 281/3 R |
| 1,290,671 | 1/1919 | Sherwood | 132/83 E |
| 3,560,025 | 2/1971 | Ostrander | 281/3 R |
| 3,583,729 | 6/1971 | DeGroot | 281/3 R |
| 3,854,229 | 12/1974 | Morgan | 283/81 |
| 4,018,237 | 4/1977 | Steiman | 132/83 R |
| 4,277,089 | 7/1981 | Lockhart | 283/81 |
| 4,425,098 | 1/1984 | Doring | 281/1 |

*Primary Examiner*—E. R. Kazenske
*Assistant Examiner*—Paul M. Heyrana, Sr.
*Attorney, Agent, or Firm*—James Creighton Wray

[57] ABSTRACT

A book in combination with a mirror is disclosed. A book such as one might ordinarily keep on one's shelf has a mirror embedded in one of the bound sections such that upon picking up the book and leafing through several pages, one is confronted with one's reflection. This allows for an added dimension to communication. The mirror is embedded in a thick section, the leaves of which may be bound and laminated together, a hole corresponding in dimensions to the mirror is cut partially therethrough, a mirror is immovably placed in said hole.

1 Claim, 2 Drawing Sheets

COMBINED BOOK AND MIRROR

BACKGROUND OF THE INVENTION

This is a continuation-in-part of Ser. No. 664,021, filed Oct. 23, 1984 now U.S. Pat. No. 4,637,631.

(1) Field of the Invention

This invention pertains to books and book binding, and more particularly to modifications of books wherein a device is combined with the book preferably the combination is such that the device is embedded.

(2) The art in this area shows books in various combinations with devices. Situations may arise where it is desirable that some device or apparatus be inserted within a book. U.S. Pat. No. 2,473,938 discloses a combined photograph album and music box. U.S. Pat. No. 170,042 discloses a photograph album which has been modified such that articles may be inserted into the book.

SUMMARY OF THE INVENTION

It is an object of the invention to provide a novel book which contains a mirror embedded within such that on reading the book one would come across a rather thick page wherein is embedded a mirror reflecting the readers face.

It is another object of this invention to provide a promotional device.

It is a further object of this invention to provide means for conveying nonverbal communication within a verbal communication media.

The invention includes a mirror embedded within a book. In the construction of the book, a series of sections in laminar alignment are bound to the spine of a cover. Each of these sections is provided with a plurality of flat rectangular sheets also in laminar alignment and these sheets are connected or bound on one of their lateral edges such that each section contains leaves bound together upon one edge. This one edge forms the bound edge which is connected to the spine of the cover. One of these sections, however, has been laminated together and a thick flexible leaf is formed. A hole has been cut into this thick flexible leaf where said hole extends partially through this thick flexible leaf. A mirror has been immovably attached within said hole such that the mirror is inset within the flexible leaf and the surface of the mirror is even with the surface of the thick flexible leaf. This book in combination with a mirror has a cover which may be of a typical cover design containing a front and back connected together by a spine.

Preferably, the leaves of each section are made of paper. The hole cut within the thick flexible leaf should be made such that it conforms to the dimensions of the mirror. A preferable shape to the hole would be rectangular. The mirror may be any flat device imparting a reflection. The cover of the book may be inflexible or flexible and may be made of any suitable material. The section of the book wherein the mirror is embedded does not have to be flexible. It may be inflexible.

An object of the invention is to provide a book apparatus comprising first and second covers, a plurality of leaves bound between the covers, and a mirror disposed within the book apparatus.

In one embodiment the mirror is disposed between the leaves of the book.

Preferably, the first and second covers comprise front and back covers.

In another embodiment the mirror is mounted in the back cover with mounting means.

The mounting means comprises a countersunk portion extending inwardly from an inner surface of the back cover, the countersunk portion corresponding in size and shape to the mirror, wherein the mirror is fitted into the countersunk portion and fixed in place.

In one embodiment, a reflective surface of the mirror is flush with the inner surface of the cover.

In another embodiment, the book comprises a cover leaf bound between the front and back covers and being adjacent an inner surface of the back cover, wherein the cover leaf overlies and conceals the mirror.

In another embodiment, the book comprises means for connecting the cover leaf to the cover.

Preferably, the connection means comprise adhesive means.

The adhesive means comprise a low tack adhesive connected to peripheral edges of the cover leaf on a surface which overlies the cover.

In another embodiment, the adhesive means comprise a low tack adhesive connected to peripheral edges of the cover on a surface overlying the cover leaf.

Preferably, the cover leaf is the last page of the book apparatus.

Alternatively, the cover leaf can be the first page of the book apparatus.

In another embodiment, the adhesive means comprise an adhesive that fixes to one surface and connects to another surface.

DESCRIPTION OF THE PREFERRED EMBODIMENT

Figure 1:
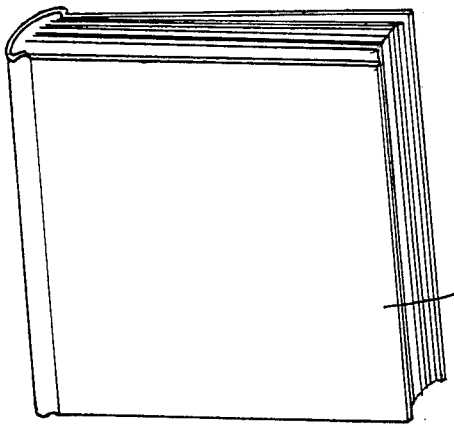
FIG. 1 is a front elevational view of a typical book.
Figure 2:
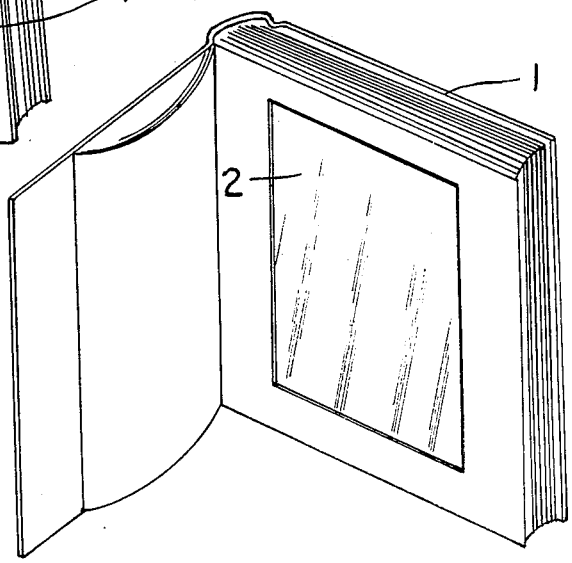
FIG. 2 is a front elevational view of the open book of FIG. 1 showing the mirror.
Figure 3:
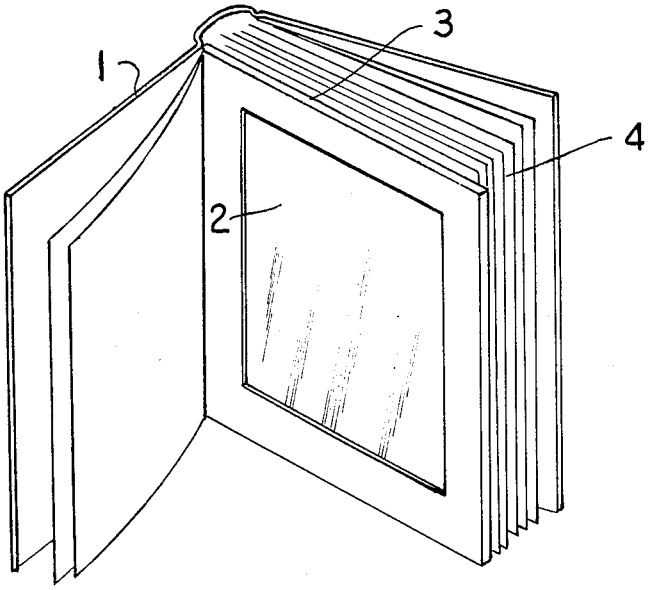
FIG. 3 is a front elevational view of the open book in FIG. 2 showing the section containing the mirror in relation to the other sections and leaves thereof.

The invention as shown in the closed position in FIG. 1 is a fairly typical appearing book. It should be noted that FIG. 1 depicts a hardbound book, but the invention contemplates a softbound book as well. Upon opening the book and leafing through several pages, the reader is confronted with their reflection in the embedded mirror 2 embedded within a thick section 3 (See FIG. 3). Referring to FIG. 3, one may readily see that the mirror 2 is embedded in a thick section 3 which is thick in relation to the normal leaves of the book as represented by the numeral 4.

The book in combination with a mirror may be constructed in any suitable book binding method. It is preferred that the book be constructed from the beginning with the idea that the mirror will be placed within. Therefore, in the binding of the book, a series of sections are bound to a cover. Each of these sections contains leaves which form the pages of the book. Initially these leaves are nothing more than flat rectangular sheets in laminar alignment. The sheets are connected to each other on one of their lateral edges such that the section is formed containing leaves bound together on one edge with that edge being the bound edge. These sections are then bound together by connecting each section to a spine of a cover. The ways for binding leaves within a section and a section within a spine are manifold. For example, glue may be used, thread in combination with glue, and rods held on the back of each section with transverse strips connected to the rod, thread connecting the transverse strips and rods together with thread connecting the rods of each section together and glue and/or thread connecting the sections to the spine of the book. The ways of connecting these sections to a cover and sections to themselves, and leaves within the sections may be performed by any suitable manner.

When gathering the sections together for binding, at least one of the sections should be laminated together to form a thick section. This thick section then is to have a hole routed within where the hole would extend partially therethrough. This hole would conform to the shape of the mirror. The mirror may be round, eliptical, square or rectangular in shape. The mirror may be attached to the hole before binding or after binding, which ever is easier. An alternative method for preparing a leaf which would contain the mirror would be to use a suitably thick planar member which would not need to be laminated and could be bound together with the other sections forming the book. This section may be of any suitable material flexible or inflexible, paper, cloth, or polymeric.

It should be noted that the book in combination with a mirror may be a hardback book or a paperback book. The technology in making the paperback book may be somewhat different than the technology of constructing a hardbound book described above.

The paperback model of the book in combination with the mirror is essentially the same as the hardback model with a few simple variations. The paperback book again would be constructed of sections containing leaves. The sections being stacked one on top of the other in laminar alignment and the sections being bound on their bound edge to a paperback cover spine. Again, the sections should contain at least one section which has been laminated together to form a thick section where a hole may be cut partially therethrough such that a mirror may be mounted within. It should be understood that the lamination of the sections may also be done after the book has been bound. It should also be understood that in the paperback example, one of the sections may also be a nonlaminated thick section which may be flexible or inflexible and which would be sufficiently thick such that a hole may be cut partially therethrough and a mirror embedded therein.

The book in combination with a mirror is a commercially attractive device. It may be used in promotional situations such as the cosmetic industry would require. Basically the device may be used in any situation where an author of a book would want to direct attention to the reader for some reason by confronting the reader with the reader's own reflection. This combination of nonverbal communication coupled with the verbal communication within the book may amount to a very powerful communication. The mirror, it has been found, greatly enhances the communicability of the book when the verbal message of the book is structured in such a way as to include the mirror in the sequence of the message conveyed.

Figure 4:
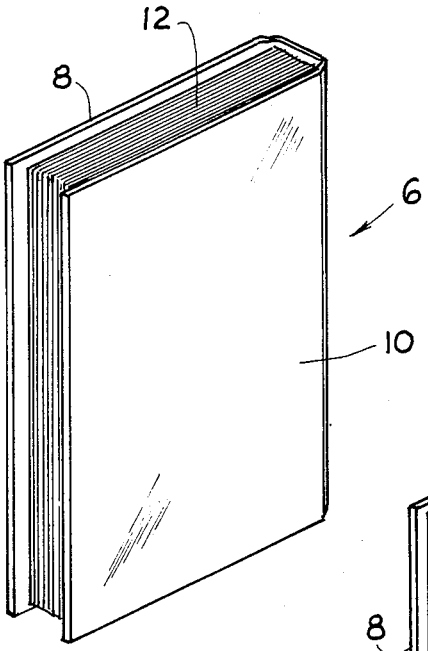
FIG. 4 is a perspective view of another embodiment of the invention.
Figure 5:
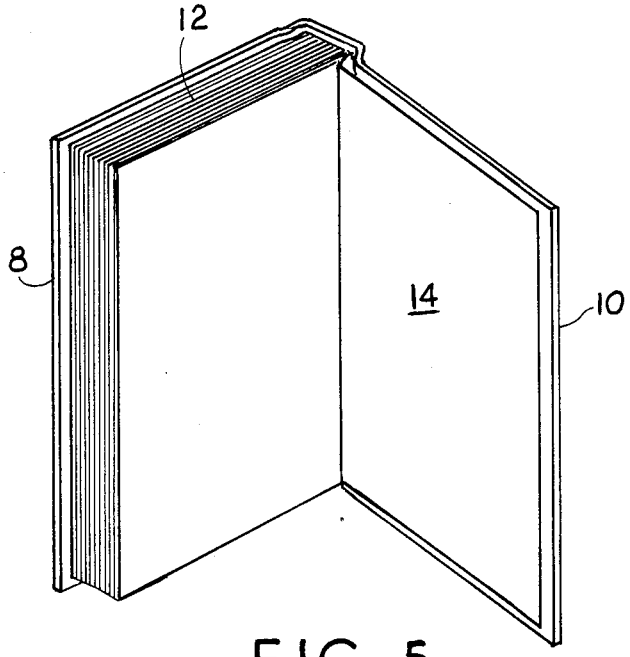
FIG. 5 is a perspective view of the embodiment of FIG. 4 with a cover pulled open.
Figure 6:
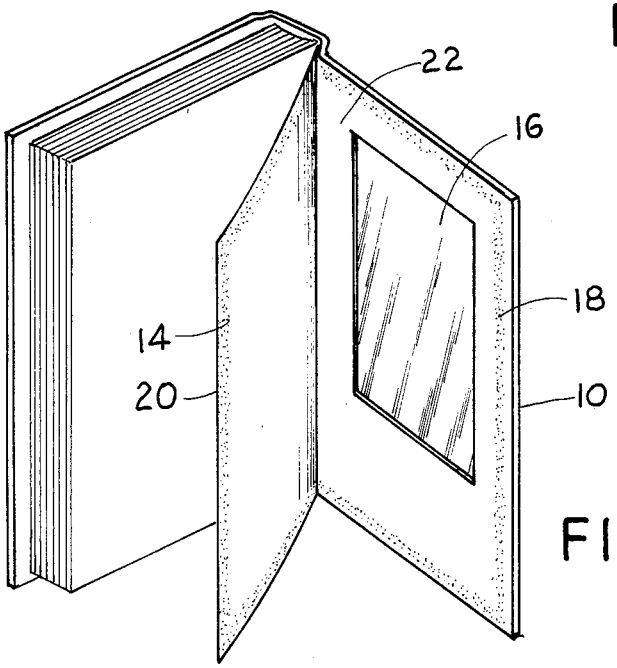
FIG. 6 is a perspective view of the embodiment of FIG. 4 with the cover leaf pulled back from the cover.

Another preferred embodiment is shown in FIGS. 4–6 where a book 6 has covers 8, 10, which bind leaves 12 therebetween.

Individual sheet 14 can be either the first or last leaf of the book, depending on the preferred use. In the illustrations, leaf 14 is the last page of the book and is connected to the back cover 10 by a low tack adhesive. The low tack adhesive may be applied to peripheral edge portions 18 of the back cover 10 or peripheral edge portions 20 of the leaf 14, or both. It is important for the low tack adhesive to permit repeated disconnection of the leaf 14 from the cover 10.

A mirror 16 is embedded into the cover in such a way as to become substantially coplanar with inner surface 22 of the cover 10.

When the book is closed, the leaf 14 overlies the inner surface 22 of the cover 10 and becomes connected thereto by means of the low tack adhesive. When the reader comes to the last page, he or she may pull at one of the corners of the leaf 14 to peel back the leaf 14 thereby revealing the mirror 16. The opposite surface of leaf 14, or a preceding leaf, may be provided with instructions to the reader on how to identify the reader by simply turning the next page. The identity of the reader may be intended to coincide with the identity of a person to whom the book is dedicated.

When the book 6 is a hard-bound version, the covers 8, 10 may be thickened cardboard or other suitable paper material or other suitable means to provide rigidity. When the thickened covers are used, the mirror can be essentially countersunk into the thickened material until the mirror surface is flush with inner surface 22 of the cover 10, or in the alternative, the mirror surface may be slightly set back or recessed from the inner surface 22.

In a paperback version, the mirror would have to be made of thin, flexible, reflective material and would be substantially laminar with respect to the back cover.

In the preferred embodiment, the cover 8 is a front cover and the cover 10 is a back cover. However, in another embodiment, the covers could be reversed such that the mirror 16 is found in the front of the book instead of the back. In that case, leaf 14 would be the first page instead of the last.

The low tack adhesive may be of the type that stays on one surface while adhering to another. In other words, the adhesive may be applied to either the leaf 14 or cover 16 and would be permanently fixed to either. If the low tack adhesive were applied to the cover 10 the adhesive would be fixed to the cover but would attach to the leaf 14 when pressed against it. However, when the leaf 14 is separated from the cover by pulling, the adhesive would stay on the cover 10 and would not become fixed to the leaf 14. Such a low tack adhesive is made by The 3M Company, Commercial Tape Division, St. Paul, Minn. The adhesive is used on "POST IT" brand removable self-stick note pads.

Low tack adhesive is necessary so that the page can be repeatedly connected and disconnected to the cover 10.

Having described the invention with particularity and disclosing how to make and use the invention, what I claim is:

1. A book apparatus comprising, a plurality of pages containing textural material and being bound between front and back covers, a mirror embedded in the back cover and having a reflective surface substantially coplanar will an inner surface of the back cover, wherein the last page of the plurality of pages overlying the inner surface of the back cover and is provided with peripheral semitack adhesive for holding the last page over the inner surface of the back cover, whereby the last page is peeled back to uncover the mirror when a reader has turned to the last page of the book, and whereby the last page conceals the mirror until the reader has finished the book.

* * * * *